United States Patent [19]

Pommerening

[11] Patent Number: 4,985,941

[45] Date of Patent: Jan. 22, 1991

[54] HYDROTHERAPY MACHINE

[75] Inventor: Bruce Pommerening, Holland, Mich.

[73] Assignee: Evans Hydrotherapy Corp., Holland, Mich.

[21] Appl. No.: 289,964

[22] Filed: Dec. 23, 1988

[51] Int. Cl.[5] ..... A61H 33/02

[52] U.S. Cl. ..... 4/495; 4/544; 128/66

[58] Field of Search ..... 4/495, 541–544, 4/592–594; 128/66, 369, 370, 400; 68/189, 195

[56] References Cited

U.S. PATENT DOCUMENTS

| | | | |
|---|---|---|---|
| 377,394 | 2/1888 | Knaak | 4/543 |
| 573,927 | 12/1896 | Schmitz | 4/543 |
| 1,350,974 | 8/1920 | Kolshorn | 4/543 |
| 1,896,938 | 2/1933 | Borowsky | 4/543 |
| 1,903,585 | 4/1933 | Annico | 68/189 |
| 2,529,255 | 11/1950 | Jobe | 4/542 |
| 2,577,727 | 12/1951 | Abbott | 68/189 |
| 2,661,865 | 12/1953 | Wendt | 128/66 X |
| 3,034,139 | 5/1962 | Kapnick et al. | 4/544 |
| 3,092,990 | 6/1963 | Schyns | 68/189 |
| 3,272,201 | 9/1966 | Burns | 128/66 |
| 3,283,756 | 11/1966 | Turley | 128/66 |
| 3,346,884 | 10/1967 | Roy | 4/592 |
| 3,455,299 | 7/1969 | Gerow | 128/66 |
| 3,581,528 | 6/1971 | Mortensen | 68/189 |
| 3,670,343 | 6/1972 | Gansloser | 4/495 |
| 3,788,306 | 1/1974 | Eberhard | 128/66 |
| 3,837,334 | 9/1974 | Johnson | 128/24.3 |
| 4,324,009 | 4/1982 | Hornsby | 4/492 |
| 4,602,391 | 7/1986 | Shepherd | 4/542 |
| 4,713,850 | 12/1987 | Flaherty et al. | 4/585 |

FOREIGN PATENT DOCUMENTS

| | | | |
|---|---|---|---|
| 1908663 | 2/1969 | Fed. Rep. of Germany | 4/543 |
| 2234088 | 1/1974 | Fed. Rep. of Germany | 4/495 |
| 639160 | 6/1928 | France | 4/542 |
| 105422 | 4/1917 | United Kingdom | 4/542 |

*Primary Examiner*—Henry J. Recla
*Assistant Examiner*—R. M. Fetsuga
*Attorney, Agent, or Firm*—Waters, Morse & Harrington

[57] ABSTRACT

This hydrotherapy machine has a top-opening tank with a floor spaced above the tank bottom. The periphery of the floor is spaced from the tank wall. Liquid under pressure is admitted to the space between the floor and the tank bottom, and proceeds upwardly through the gap between the tank wall and the floor. The circulation continues along the tank wall, and downward to a central outlet traversing the floor and the tank bottom. An inward radial flow at the top completes the primary circulation pattern.

7 Claims, 7 Drawing Sheets

HYDROTHERAPY MACHINE

BACKGROUND OF THE INVENTION

The usual hydrotherapy machine includes a tank and a pumping system for inducing circulation of liquid within the tank. The particular liquid within the tank is usually prepared according to the needs of the treatment being administered. Usually, the liquid will be water with selected additives. Selected temperatures can usually be maintained by the use of a heater interposed in the plumbing system. A patient is usually seated near the edge of the tank, immersing whatever portion of his body is being subject to treatment. Larger machines are capable of receiving the whole body of a patient, somewhat in the manner of a bathtub. The fairly high velocity of circulation of liquid within the tank has the effect of stimulating the peripheral portions of the body and relaxing the interior muscles. Blood circulation can usually be increased in the areas around an injury, and solutions can be prepared that are appropriate for treating burns and other open skin lesions. The velocity of circulation is usually controllable as particular conditions on the patient's body may require. These machines also commonly include an air injection system that provides small entrained air bubbles, which seem to be beneficial in certain types of treatment. The addition of small quantities of detergent will sufficiently reduce the surface tension of the liquid to produce a smaller bubble size.

Conventional hydrotherapy machines produce the circulation within the tank with the use of transverse jets emerging from nozzles in various locations. Usually the directional orientation of these jets is horizontal, producing undesirable impact areas that can produce discomfort and possible damage to sensitive areas on the body. The use of jets also tends to produce stagnant areas in the tank, and correspondingly wide fluctuations in the velocity of circulation at various points where the patient's body may be immersed.

SUMMARY OF THE INVENTION

The tank of this hydrotherapy machine has a floor spaced above the bottom of the tank, with a small gap between the periphery of the floor and the tank wall. Liquid under pressure is admitted to the space between the floor and the tank bottom, and a central outlet from the tank traverses the floor and the tank bottom. The effect is to generate a toroidal circulation upward along the tank wall, and downward along the central vertical axis, with a generally radial flow at the top and (to a limited extent) at the floor.

DESCRIPTION OF THE PREFERRED EMBODIMENT

Figure 1:
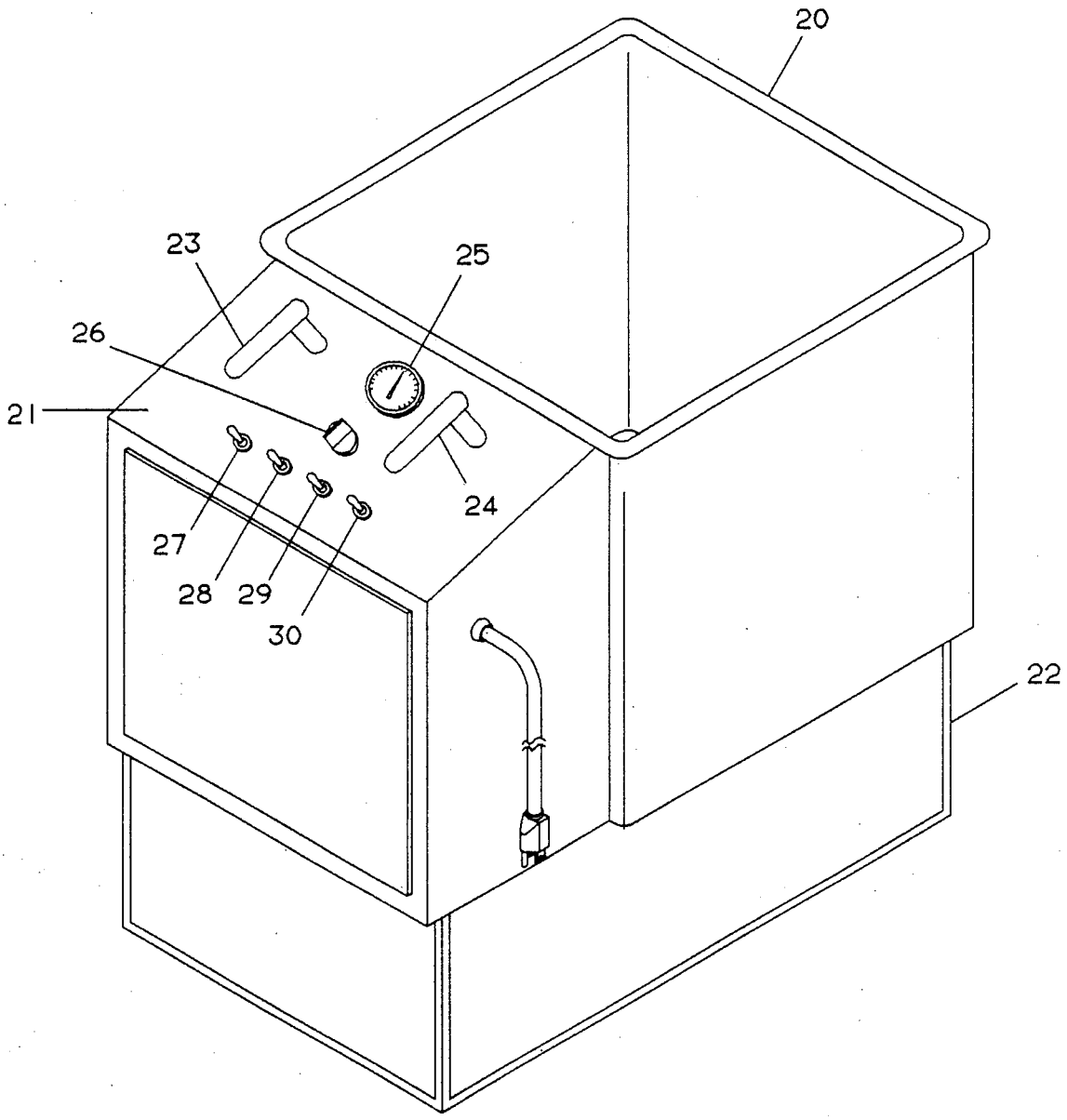
FIG. 1 is a perspective view of a hydrotherapy machine embodying the present invention.
Figure 2:
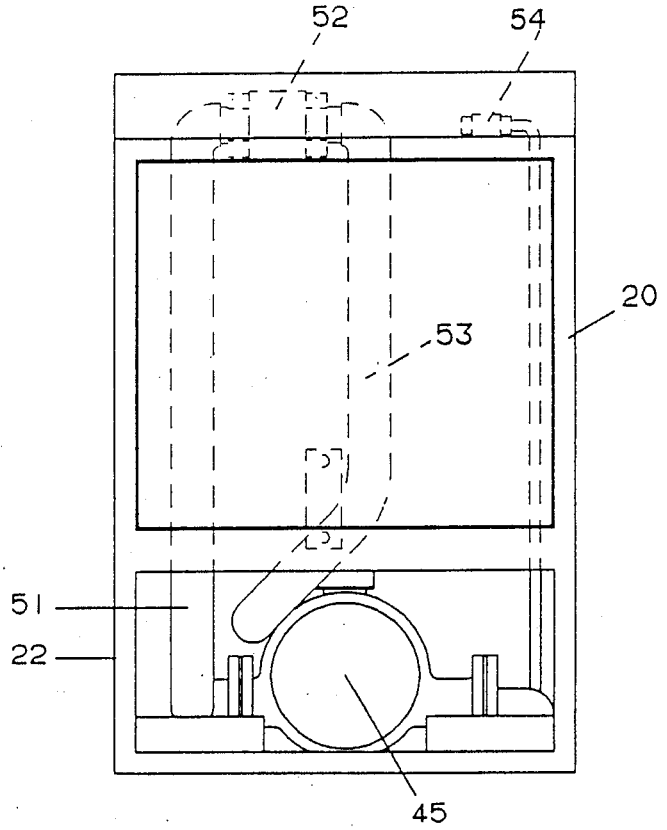
FIG. 2 is a top view of the unit shown in FIG. 1, with the control box removed.

Referring to FIG. 1, the machine includes a tank 20 and a control box 21 mounted on the base structure 22. The controls include the handle 23 controlling the rate of circulation in the tank, and the handle 24 for regulating the injection of air into the liquid. The gauge 25 registers the temperature of the liquid, and the knob 26 is the temperature control. The toggle switches 27–30 control the power, circulation pump, the heater, and the drain pump, respectively.

Figure 3:
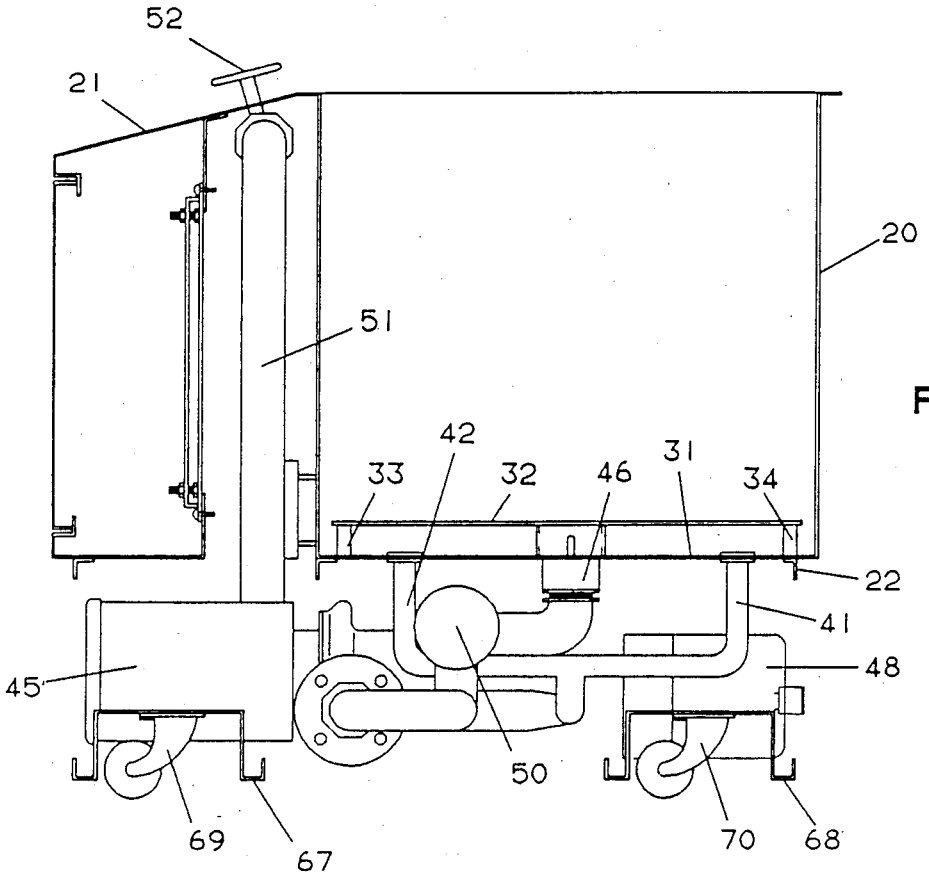
FIG. 3 is a sectional side elevation of the machine the right, as viewed in FIG. 1.
Figure 4:
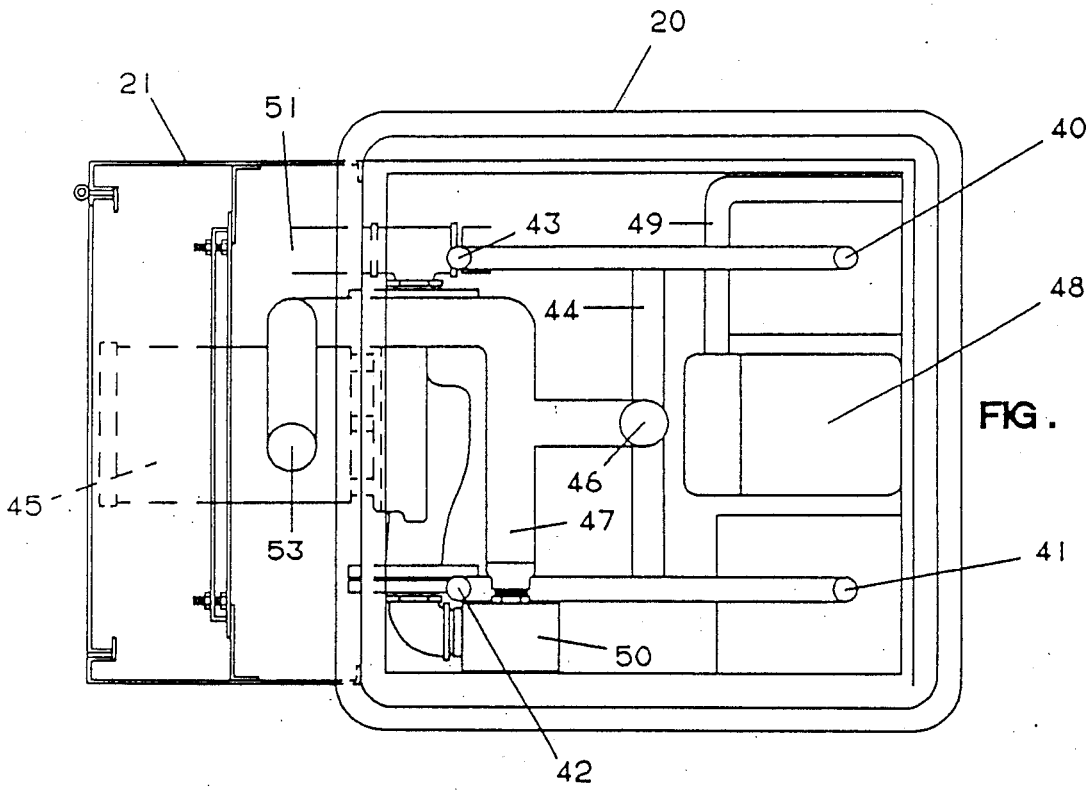
FIG. 4 is a top view on a horizontal plane below the level of the tank.
Figure 5:
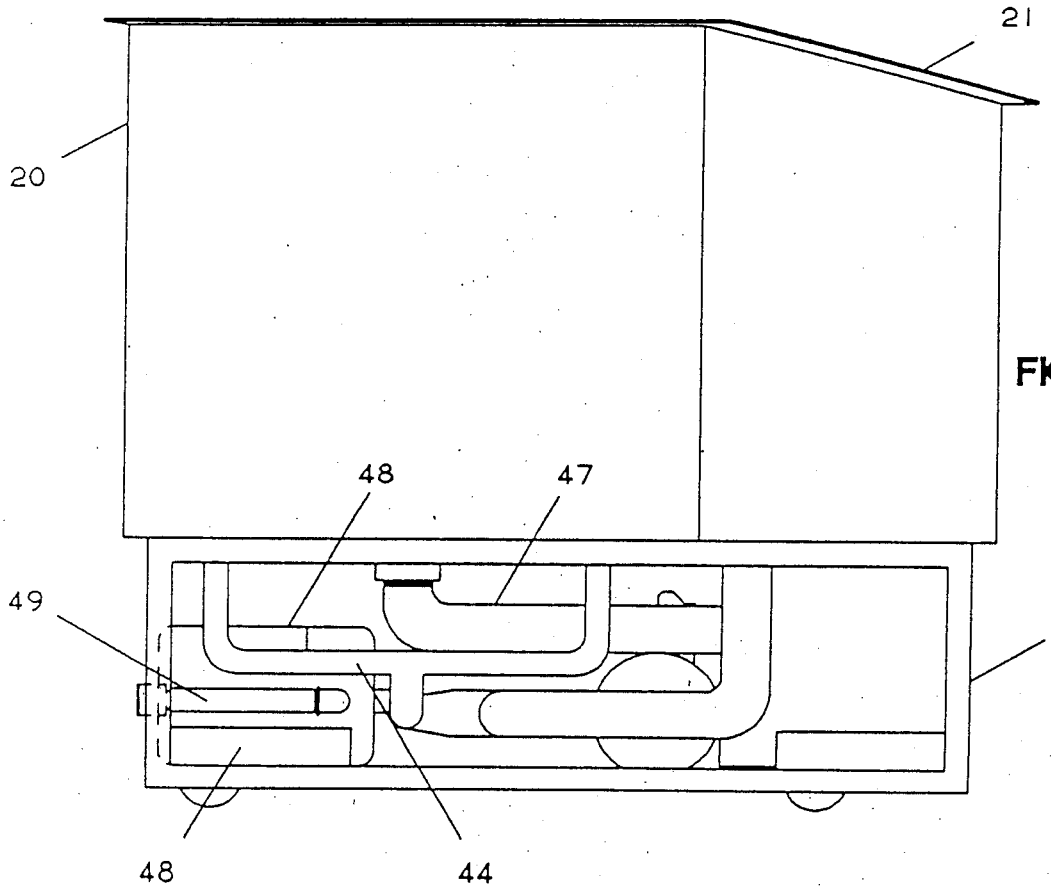
FIG. 5 is a side elevation of the left side of the machine, as viewed in FIG. 1, with the cover panels removed from the lower portion.
Figure 8:
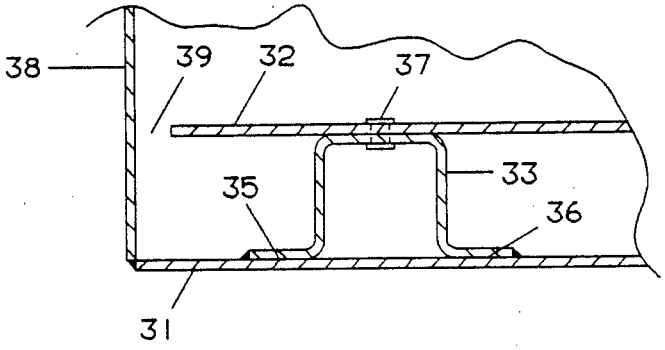
FIG. 8 is a fragmentary sectional elevation on an enlarged scale, showing one of the supports for the floor of the tank.

Referring to FIGS. 2–5, the tank 20 has a bottom 31 and a floor 32 spaced above the bottom as a result of resting on pedestals as shown at 33 and 34 in FIG. 3. These pedestals are shown in detail in FIG. 8, and are pieces of strip metal bent into a hat-shaped configuration. The lower flanges 35 and 36 are welded to the bottom 31 of the tank, and the floor 32 is secured to the top of the pedestals with a rivet as shown at 37. The periphery of the floor 32 extends to a position adjacent the side wall 38 to produce a gap 39 all around the tank. Liquid under pressure is admitted to the space between the bottom 31 and the floor 32 at four spaced points 40–43 (refer to FIG. 4) in the four corners of the square tank 20. These outlets, or inlets into the tank, are fed by the supply conduit 44 communicating with the output of the circulating pump 45. The central drain 46 from the tank is connected to the intake of this pump through the conduit 47. Larger tanks may be rectangular and provided with more inlet points and drains. The drain pump 48 can be activated to discharge the contents of the tank through the pipe 49. The intake of this pump is preferably connected into the system at the lowest convenient point. An optional heater as shown at 50 may be incorporated, and this is usually provided in the portable units of the type illustrated in the drawings. In permanent installations where the machine is connected to the hot and cold water systems of the surrounding building, the heater would be replaced by a control valve in the hot water line.

The circulation pump 45 is of the centrifugal type, and is rated at eighty (80) gallons per minute against a fourteen (14) foot head of pressure. In the installation conditions present in this machine, this pump will produce a flow of approximately one hundred twenty (120) gallons per minute. The rate of circulation within the tank is controlled by the bypass conduit which includes the riser 51 leading to the valve 52 controlled by the handle 23 at the control panel. From this point, the flow proceeds back downward through the descending section 53 to a return to the pump. The air injector 54 is preferably incorporated in the bypass circuit, providing the most convenient point for the manipulation of its associated control valve and handle 24.

Figure 7:
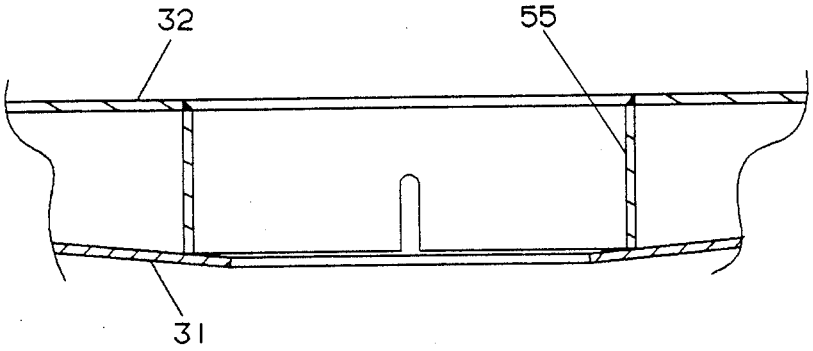
FIG. 7 is a fragmentary sectional elevation of the central outlet from the tank, on an enlarged scale.

Throttling or opening the bypass valve, with the circulation pump running at substantially constant speed, will have the obvious effect of controlling the velocity of circulation within the tank. A freer flow through the bypass circuit will apply less pressure to drive the circulation. The structure permitting this circulation to pass through the floor 32 and bottom 31 of the tank is shown in FIG. 7. A cylindrical wall 55 extends between the floor and the tank bottom, and is preferably welded to the floor. This opening receives the drain 46, shown in FIG. 3. The drain is sealed into the opening shown in FIG. 7 by conventional plumbing arrangements.

Figure 6:
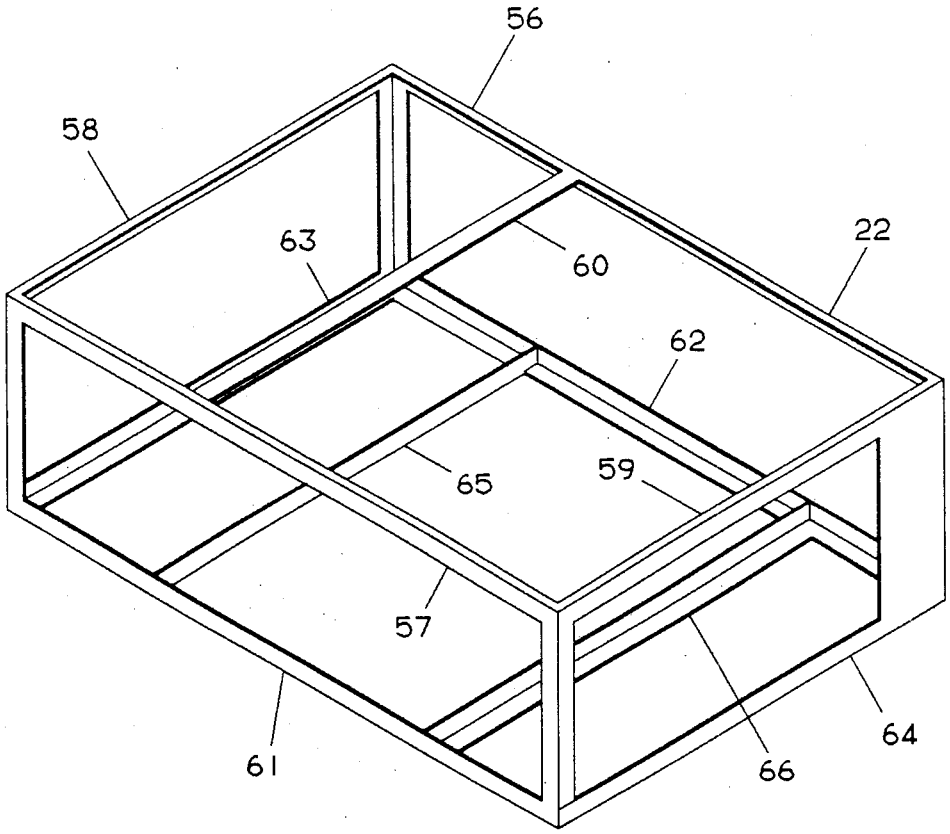
FIG. 6 is a perspective view showing the frame of the machine.

FIG. 6 shows the support structure for the machine, which is the frame 22 constructed of so-called "angle iron" components welded together in the illustrated configuration. These components include the upper side members 56 and 57, the upper end members 58 and 59, the central transverse member 60, the lower side members 61 and 62, the lower end members 63 and 64, and the lower intermediate transverse members 65 and 66. Referring to FIG. 3, wheel wells are provided at the four corners of the base structure as indicated at 67 and 68. These form housings for casters as shown at 69 and 70. Permanent installations of these therapeutic machines, of course, would not include this structure.

Figure 10:
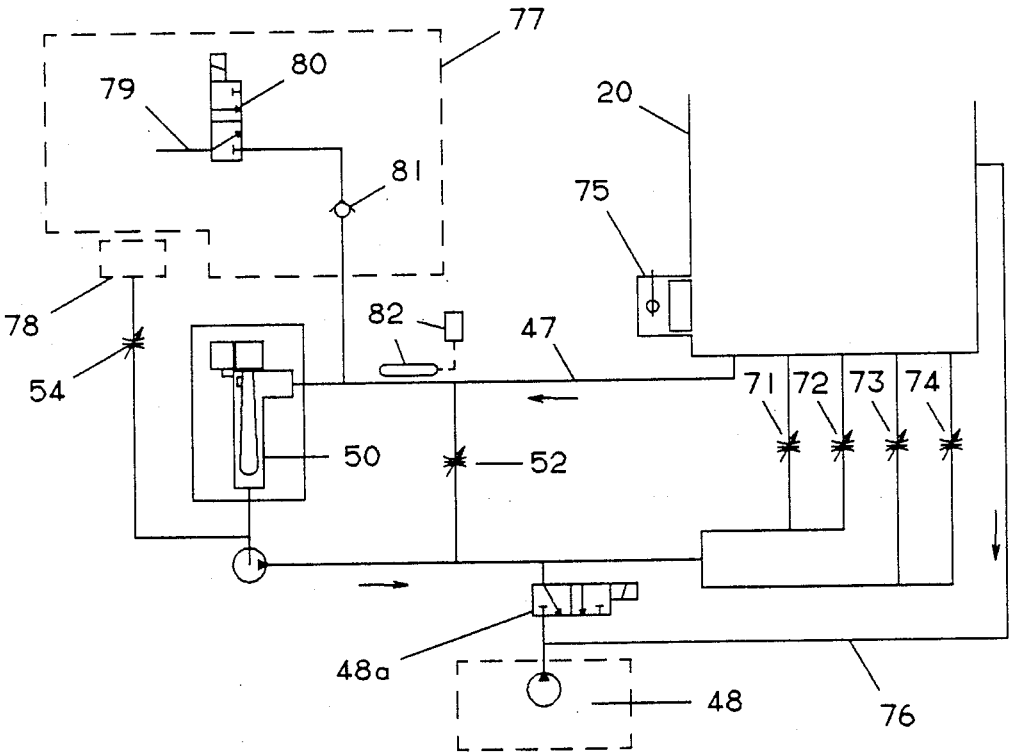
FIG. 10 is a schematic representation showing the plumbing system.

Referring to FIG. 10, the schematic diagram of the plumbing of the machine shows the preferred use of balancing valves 71–74 associated respectively with the flow inlets 40–43 so that the flow into the space between the bottom of the tank and the floor can be equalized by adjustment. A low water cutout is also preferably incorporated at 75, which is essentially a conventional float-controlled device responsive to the level of liquid in the tank 20. A solenoid-operated valve 48*a* controls the drain, and it is preferable to incorporate an overflow line as shown at 76 to assure that the tank is not overfilled. The area indicated in dotted lines at 77 on the FIG. 10 diagram illustrates an optional hot water control system for permanent installations. A conventional "bubbler" is indicated at 78 controlled by the valve 54, with the injection of the air being accomplished either through aspiration or by a small pump unit. In the optional hot water system, the hot water supply line is indicated at 79, with the solenoid-control valve shown at 80. A check valve is indicated at 81, which is usually a code requirement. A conventional temperature-control system is indicated at 82.

Figure 9:
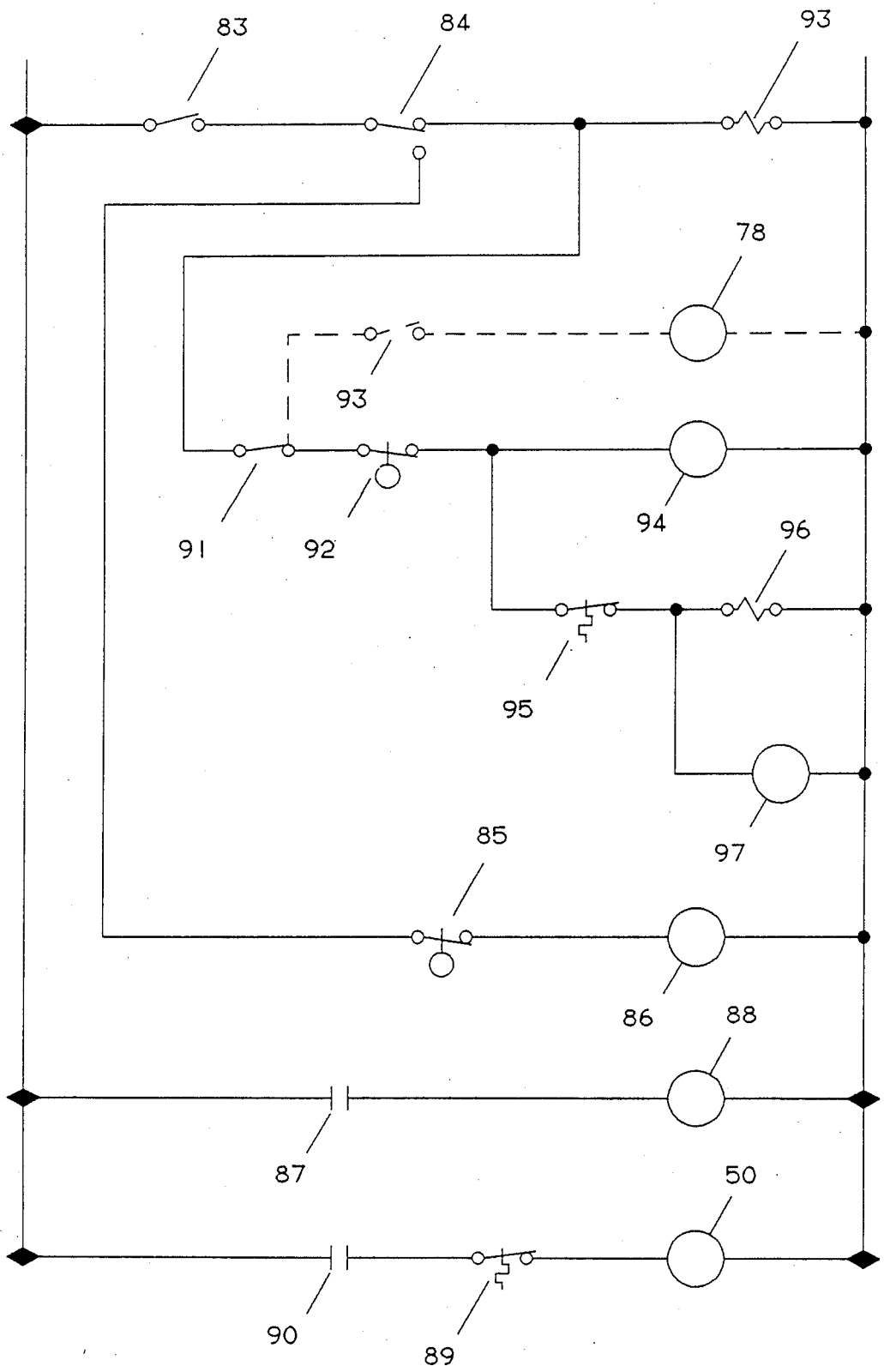
FIG. 9 is a schematic representation of the electrical system associated with the machine.

Referring to FIG. 9, the electrical system presented in this schematic diagram includes the pilot switch 83 and the drain switch 84. An internal switch is indicated at 85, which is associated with the pump motor 86. A control switch is indicated at 87 for the circulation pump motor 88. The optional heater 50 is controlled by the safety thermostat 89 and the activating switch 90. The circulation pump motor control is indicated at 91, with the low water cut out switch shown at 92 being associated with the unit 75 appearing in FIG. 10. The drain solenoid is shown at 93. A pump contactor appears at 94, and the water thermostat 95 is associated with the hot water solenoid (optional) 96 or the water heater 97.

The machine illustrated in the drawings is typical of a small portable unit. The particular model illustrated stands thirty-four (34) inches high from the floor, and the tank is twenty-four (24) inches square at the top opening, and twenty-seven (27) inches deep. The floor is spaced approximately thirteen-sixteenths (13/16) of an inch above the bottom of the tank, with the gap between the periphery of the floor and the tank wall preferably one-fourth ($\frac{1}{4}$) of an inch. Using the rate of flow provided by the pump output at 120 gallons per minute, the flow through the gap should be maintained between three (3) and ten (10) gallons per minute per linear foot to induce a range of circulation capable of accommodating the various treatment needs, having in mind the flow adjustability provided by the bypass circuit.

I claim:

1. A hydrotherapy machine including a tank having a bottom and side wall means, and means operative to circulate liquid within said tank, wherein the improvement comprises:

a floor panel mounted within said tank in a substantially horizontal position spaced above the bottom of said tank, and extending laterally to within close proximity to said sidewall means to form a gap between the periphery of said floor panel and side wall means, said floor panel having a central opening;

first conduit means, communicating with said circulating means from below said floor panel and the space between said tank bottom and floor panel; and second conduit means, said second conduit means communicating with said circulating means from below said floor panel and the space within said tank above said floor panel directly through said central opening, said circulating means thereby inducing a toroidal circulation within said tank.

2. A machine as defined in claim 1, wherein said gap is between one quarter ($\frac{1}{4}$) and one half ($\frac{1}{2}$) inch.

3. A machine as defined in claim 2, wherein said circulating means is operative to maintain a flow through said gap of at least three (3) gallons per minute per foot of length of said gap.

4. A machine as defined in claim 1, wherein said floor panel is at least thirteen-sixteenths (13/16) of an inch above the bottom of said tank.

5. A machine as defined in claim 1, wherein said first conduit means includes a plurality of inlet ports distributed uniformly about the bottom of said tank.

6. A machine as defined in claim 5, wherein said circulating means includes balancing valves adapted to equalize the flow through said ports.

7. A machine as defined in claim 1, wherein said circulating means includes a bypass conduit having a control valve disposed adjacent the top of said tank.

* * * * *